US006042159A

United States Patent [19]

Spitzley et al.

[11] Patent Number: 6,042,159

[45] Date of Patent: Mar. 28, 2000

[54] DOOR HANDLE ASSEMBLY

[75] Inventors: Larry Spitzley, Mulliken; James P. Larabel, Newago, both of Mich.

[73] Assignee: ADAC Plastics, Inc.

[21] Appl. No.: 08/904,794

[22] Filed: Aug. 1, 1997

[51] Int. Cl.[7] ..... E05C 3/06

[52] U.S. Cl. ..... 292/216; 292/DIG. 65

[58] Field of Search ..... 292/336.3, DIG. 22, 292/DIG. 65, 169.11, 216, 344

[56] References Cited

U.S. PATENT DOCUMENTS

| | | | |
|---|---|---|---|
| 2,710,213 | 6/1955 | Hottel | 292/207 |
| 3,153,553 | 10/1964 | Sandor | 292/336.3 |
| 3,159,415 | 12/1964 | Sandor | 292/336.3 |
| 3,250,558 | 5/1966 | McClintock | 292/229 |
| 3,528,695 | 9/1970 | Peters | 292/336.3 |
| 3,544,148 | 12/1970 | Sandor | 292/336.3 |
| 3,719,248 | 3/1973 | Breitschwerdt et al. | 180/112 |
| 3,909,051 | 9/1975 | Nakai | 292/166 |
| 3,993,338 | 11/1976 | Cherbourg et al. | 292/336.3 |
| 4,482,179 | 11/1984 | Johnson | 292/336.3 |
| 4,588,219 | 5/1986 | Kobayashi et al. | 292/336.3 |
| 4,778,207 | 10/1988 | Gergoe | 292/336.3 |
| 4,796,934 | 1/1989 | Kesel et al. | 292/336.3 |
| 5,007,668 | 4/1991 | Di Giusto | 292/216 |
| 5,011,202 | 4/1991 | Kato et al. | 292/336.3 |
| 5,092,642 | 3/1992 | Lindmayer et al. | 292/336.3 |
| 5,431,462 | 7/1995 | Lignell | 292/336.3 |
| 5,669,642 | 9/1997 | Kang | 292/336.3 |

FOREIGN PATENT DOCUMENTS

| | | |
|---|---|---|
| 632123 | 11/1949 | United Kingdom . |
| 1120527 | 7/1968 | United Kingdom . |

*Primary Examiner*—D. Glenn Dayoan
*Assistant Examiner*—Paul Chenevert
*Attorney, Agent, or Firm*—Young & Basile, PC

[57] ABSTRACT

A door handle assembly for a motor vehicle which acts to preclude inadvertent unlatching of the door in response to a side impact. The assembly includes a side impact detector member operative in response to a side impact against the door with the handle in its closed position to move inertially from a neutral position, allowing movement of the handle to its open position, to a side impact position, blocking movement of the handle to its open position. The door handle assembly includes an actuator lever operated by the door handle and mounted for pivotal movement in response to movement of the handle, and the side impact detector member comprises a lever pivotally mounted on the actuator lever. The side impact lever normally forms a linear extension of the actuator lever but pivots inertially relative to the actuator lever in response to side impact to a position blocking opening movement of the handle.

10 Claims, 4 Drawing Sheets

10
34
34b
36
30c
40
54
32a
32
28h
28
38
32b
30b
28e
28d
28c
28b
26
41
28g
30c
30a
30

10
28c
30d
30e
32
54
32a
40
39
32b
30b
28a
38
30c
28f
41
26a
26
28b
28i
30a
4
4

DOOR HANDLE ASSEMBLY

BACKGROUND OF THE INVENTION

This invention relates to handle assemblies and more particularly to handle assemblies for controlling the latch mechanisms on vehicle doors.

Vehicle doors typically include a latch mechanism for latching and unlatching the door to the vehicle body, a handle assembly positioned on the door and operative to control the latch mechanism, and a lock mechanism to selectively render the handle assembly effect or ineffective to operate the latch. It is imperative that side impact against the vehicle, resulting for example from a collision, not result in the inadvertent movement of the handle of the handle assembly to a latch release position with consequent movement of the latch to an unlatched position and consequent inadvertent opening of the door. This in general is not a problem when the door is locked since in this case the door handle is either precluded from movement by the lock mechanism or the door handle is allowed to freewheel to its unlatched position but this movement is ineffective to move the latch to its unlatched position. However, when the door is unlocked, as is most typically the case in an operating vehicle, side impact can easily result in inertial movement of the door handle to its unlatched position with consequent unlatching of the latch mechanism, consequent opening of the door, and consequent discharge of unbuckled vehicle passengers from the vehicle.

Various attempts have heretofore been made to address the side impact problem and specifically to avoid inadvertent opening of the vehicle door in a side impact situation. In the most commonly employed arrangement, a heavy duty spring is employed in association with the door handle This spring may be sized, for example, to preclude movement of the door handle to its open position in crash situations involving up to 30 Gs of impact force. Whereas this arrangement satisfies the existing Federal Motor Vehicle Safety Standards with respect to side impact, it also results in a door handle that is very difficult to open because of the heavy duty spring employed in association with the door handle. This arrangement has the further disadvantage that the magnitude of the side impact force that the door handle assembly can withstand without inadvertent opening of the door is limited by the strength of the spring associated with the door handle so that, for example, if the door handle spring is sized to resist a 30 G impact force, any side impact force in excess of 30 G will result in opening of the door.

SUMMARY OF THE INVENTION

This invention is directed to the provision of an improved door handle assembly for use with a vehicular door.

More specifically, this invention is directed to the provision of a vehicle door handle assembly that operates to preclude inadvertent opening of the door in the event of a side impact against the vehicle.

The invention door handle assembly is intended for use with a vehicle including a door and a latch assembly mounted on the door and controlled by the door handle assembly. The door handle assembly in known manner includes a door handle adapted to be grasped by an operator and mounted proximate an exterior surface of the door for movement between a latched position in which the latch assembly maintains the door in a latched condition and an unlatched position in which the latch assembly is moved to an unlatched condition.

According to the invention, the door handle assembly includes a side impact detector member operative in response to a side impact against the door with the handle in its closed position to move inertially from a neutral position, allowing movement of the handle to its open position, to a side impact position, blocking movement of the handle to its open position. This arrangement provides a simple and effective means of precluding inadvertent opening of the door in a crash situation.

According to a further feature of the invention, the assembly provides less resistance to movement of the side impact member to its side impact position then to movement of the door handle to its open position. This arrangement ensures that the side impact member will move to its blocking, side impact position prior to movement of the door handle toward its open position.

According to a further feature of the invention, the door handle assembly includes an actuator lever operated by the handle and mounted for pivotal movement in response to movement of the handle, and the side impact detector member comprises a lever pivotally mounted on the actuator lever. This arrangement provides a simple and effective means of providing the desired blocking action in a side impact situation.

In the disclosed embodiment of the invention, the actuator lever comprises a bellcrank lever; the bellcrank lever is pivotally mounted between its ends to the door; the side impact lever is pivotally mounted to the free end of one leg of the bellcrank lever; the door handle assembly further includes a link pivotally mounted to a free end of another leg of the bellcrank lever and operating the door latch of the door handle assembly; and the door handle is pivotally mounted at one end thereof on the door and engages at another end thereof with the bellcrank lever at a location between the bellcrank lever pivot axis and the free end of the one leg of the bellcrank lever.

DESCRIPTION OF THE PREFERRED EMBODIMENT

Figure 1:
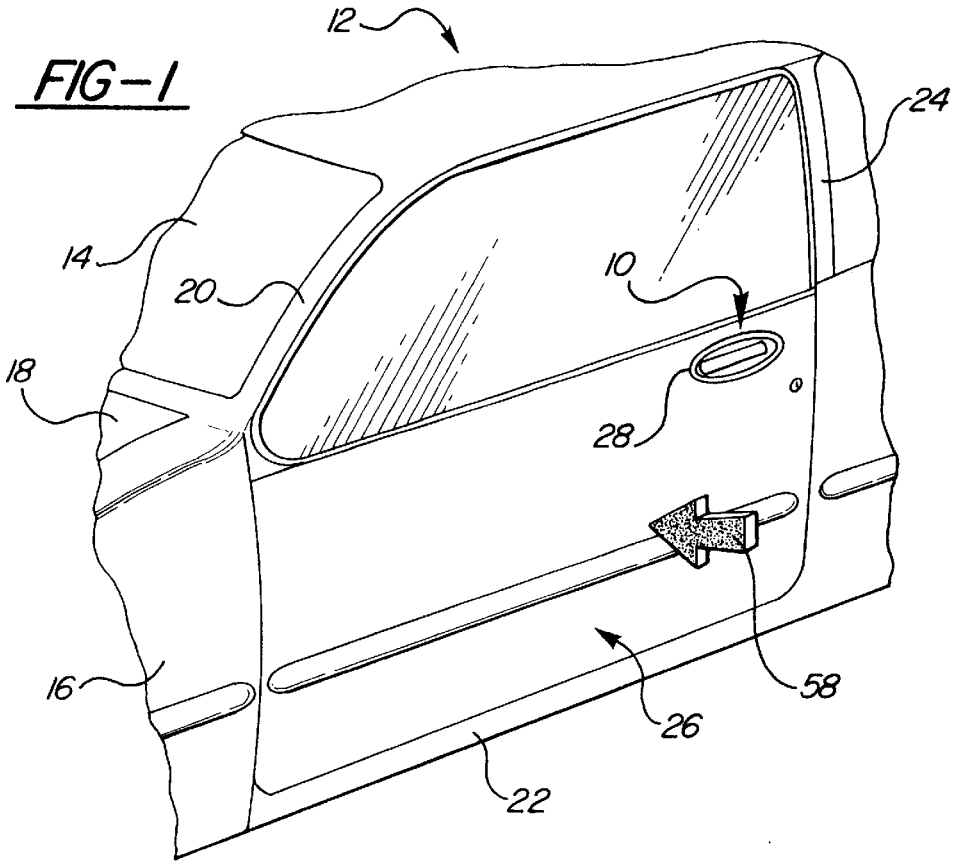
FIG. 1 is a fragmentary perspective view of a motor vehicle including a door embodying the door handle assembly of the invention.
Figure 9:
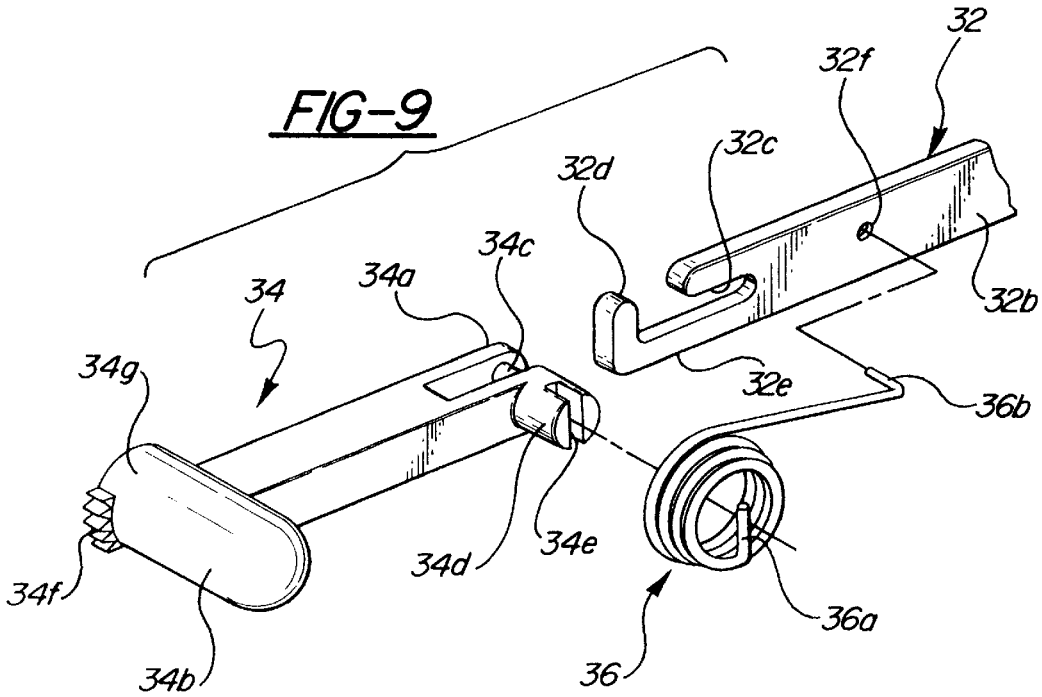
FIG. 9 is an exploded fragmentary perspective view of a portion of the handle assembly.

The invention door handle assembly 10 is seen in FIG. 1 in association with a fragmentarily shown motor vehicle 12 including a windshield 14, a front quarter panel 16, a hood 18, an A pillar 20, a sill 22, a B pillar 24, and a door 26 positioned in the door opening defined by the A pillar 20, front quarter panel 16, sill 22, and B pillar 24.

Door handle assembly 10, broadly considered, includes an escutcheon or housing 28, a handle 30, an actuator lever 32, a side impact lever 34, and a coil spring 36. Escutcheon 28 includes a main body portion 28*a* defining a cavity 38, a peripheral flange portion 28*b* suitably secured to door 26 to position the escutcheon in a suitable opening 26*a* in the door 26, and a stop portion 28*c*. Stop portion 28*c* defines a stop surface 28*d* extending generally parallel to the plane of the door and a further stop surface 28*e* extending inwardly from surface 28*d* and extending generally normal to the plane of the door. A plurality of successive teeth or serrations 28*f* are provided on stop surface 28*d*.

Handle 30 includes an elongated main body portion 30*a* sized to fit within cavity 38 and a leg portion 30*b* provided at one end of the main body portion. The other end of the main body portion includes a lug 30*c* receiving a pivot pin 41 mounted on a lug 28*g* on the escutcheon to pivotally mount the handle on the escutcheon. Leg 30*b* extends inwardly from main body portion 30*a*, passes through a suitable opening 28*i* in the escutcheon, and defines an opening 30*d* proximate the inner end 30*e* of the leg portion.

Actuator lever 32 has a bellcrank configuration including a first leg portion 32*a* and a second leg portion 32*b*. Actuator lever 32 is pivotally mounted at the juncture of leg portions 32*a*, 32*b* on a pivot pin 39 mounted on a lug 28*h* on the escutcheon with the leg portion 32*b* extending loosely and slidably through opening 30*c* in the leg portion 30*b* of the handle. Opening 30*c* will be seen to be oversized with respect to the thickness of leg 32*b*. A slot 32*c*, defining an opening 32*b*, is provided in the free end 32*e* of leg portion 32*b*. A coil spring 40 surrounds pivot pin 39 and is arranged to yieldably resist counterclockwise pivotal movement of the actuator lever and thereby resist opening movement of the handle.

Side impact lever 34 is bifurcated proximate one end 34*a* of the lever and a weight 34*b* is provided at the other end of the lever. A pivot pin 34*c* is provided at the bifurcated end of the lever and is pivotally received in the slot 32*c* in the free end 32*e* of the leg portion 32*b* of the actuator lever. A plurality of successive arcuately arranged teeth or serrations 34*f* are provided on weight 34*b* proximate an offset end 34*g* of the weight. Teeth 34*f* are sized for ratcheting, latching coaction with teeth 28*f* on stop surface 28*d*.

Coil spring 36 is positioned in surrounding relation to a free end 34*d* of pivot pin 34*c*, passes at its cranked inner end 36*a* through a slot 34*e* in pin free end 34*d* so as to rotate with pin 34*c*, and is received at its outer end 36*b* in an anchor hole 32*f* in the free end 32*e* of the actuator lever. Spring 36 is arranged to normally maintain side impact lever 34 in a neutral position forming a linear extension of the actuator lever and extending generally parallel to the plane of the door, but to readily allow pivotal movement of the side impact lever about the axis of pin 34*c* in a counterclockwise direction. This pivotal movement of the side impact lever is resisted by coil spring 36 which is sized to maintain the side impact lever in its neutral position forming a linear extension of the actuator lever during normal operation of the door handle assembly but which offers minimal resistance to counterclockwise movement of the side impact lever about the axis of pin 34*c*. Coil spring 36 may, for example, be formed of piano or music wire.

Figure 8:
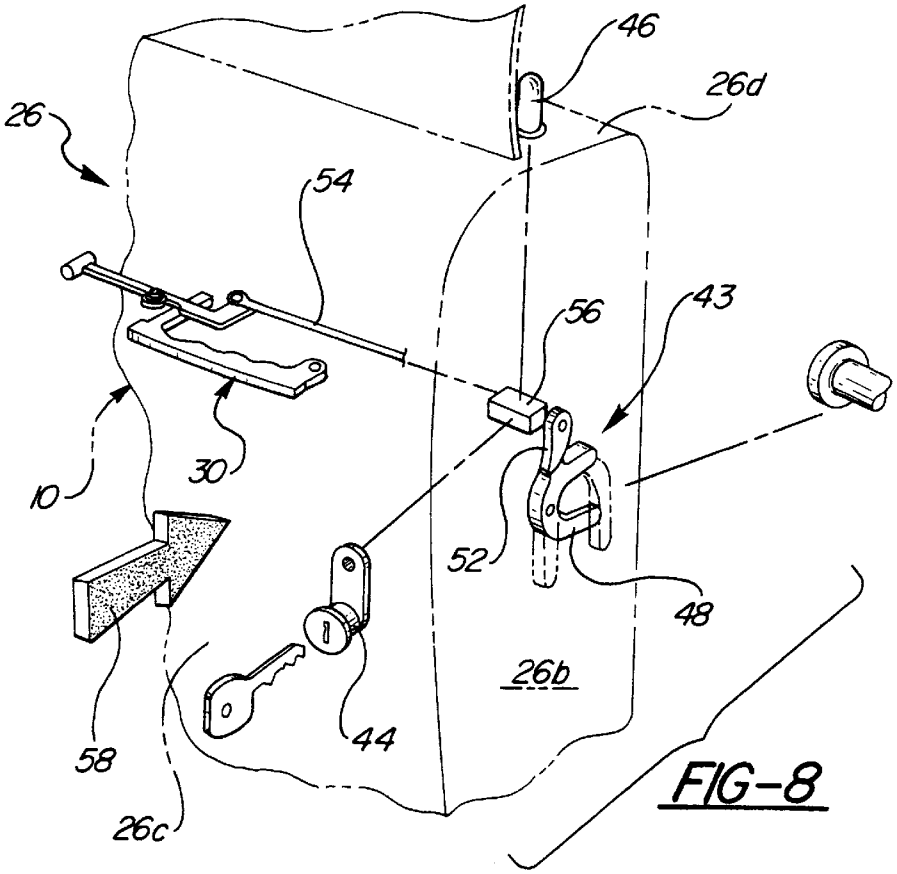
FIG. 8 is a perspective, fragmentary somewhat schematic view of the invention door handle assembly incorporated in a vehicular door assembly.

As best seen in FIG. 8, door handle assembly 10 is intended for use with a vehicular door assembly including door 26, a latch assembly 43 positioned on the shut face 26*b* of the door, a key cylinder lock 44 positioned in the outer skin 26*c* of the door proximate door handle assembly 10, and a push button lock 46 positioned on the top sill 26*d* of the door in overlying relation to latch assembly 43 and coupled for joint operation with key cylinder lock 44.

Latch assembly 43 is of known form and includes a latch member 48 coacting with a bolt 50 on the confronting face of the vehicular structure to pivotally move the latch member 48 between its illustrated solid line unlatched position and its dotted line latched position. Latch assembly 43 further includes a dog 52 coacting with a detent on latch member 48 to maintain the latch member in its latched condition against the bias of a spring (not shown) and operative when released to allow the latch member to return under the bias of the spring to the unlatched position and thereby move the door to an unlatched position. Dog 52 is controlled in known manner by a link or rod 54 secured to the free end of actuator lever leg portion 32*a*.

Specifically, pivotal movement of bellcrank 32, with key cylinder 44 and push button 46 in an unlocked condition, has the effect of releasing the latch 48 for movement to an unlatched position. However, latch assembly 43, in known manner, further includes a decoupling mechanism 56 (shown schematically) which serves to render the rod 54 ineffective to release the latch member 48 when the push button 46 and lock cylinder 44 are in a locked condition.

Figure 2:
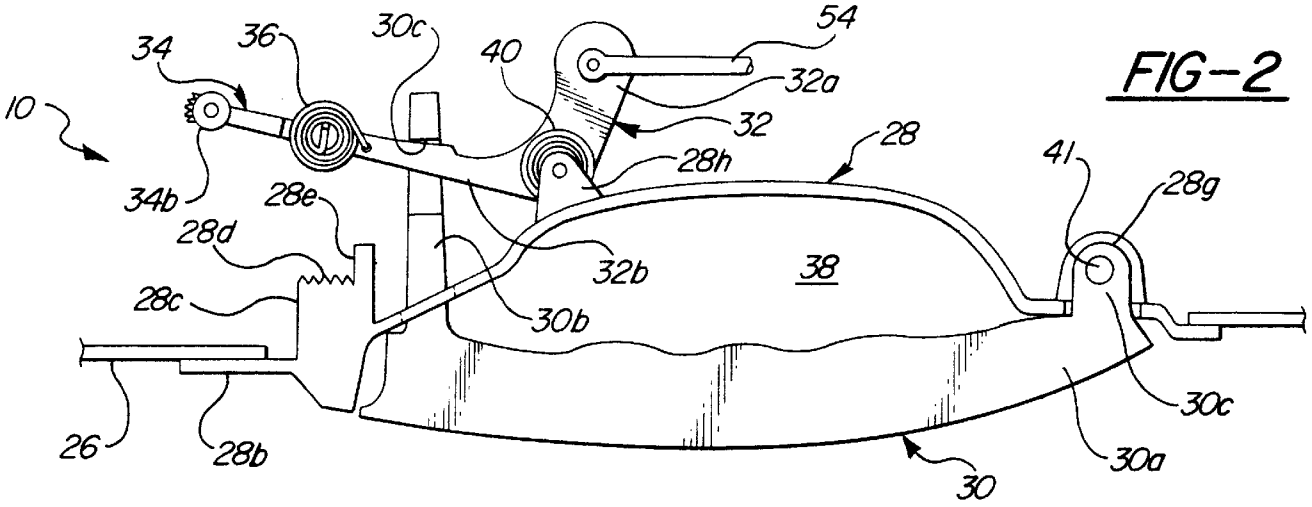
FIG. 2 is a top view of the handle assembly in a door closed position.
Figure 3:
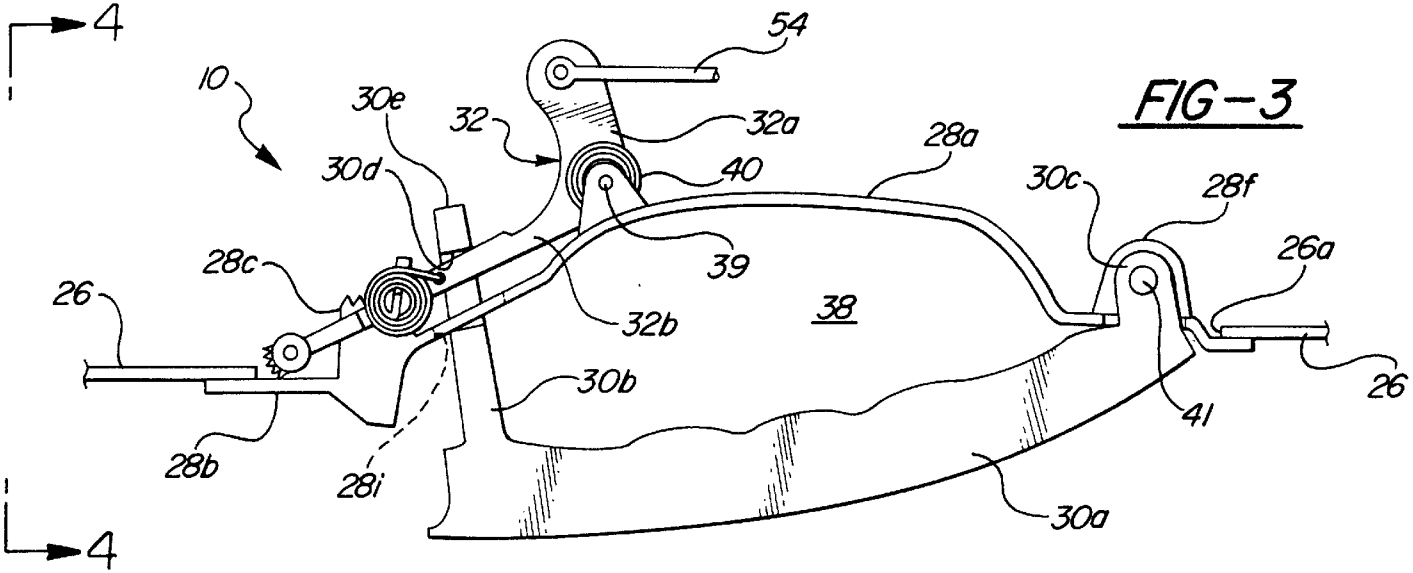
FIG. 3 is a top view of the handle assembly in a door open position.
Figure 4:
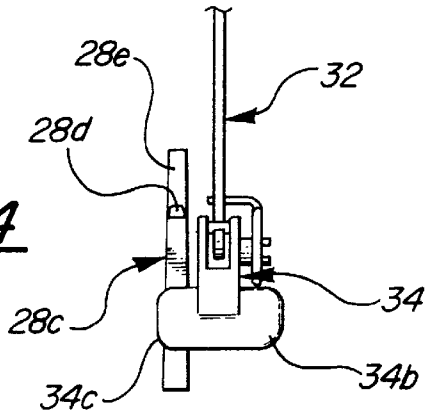
FIG. 4 is a fragmentary end view looking in the direction of the arrow 4 in FIG. 3.

The normal operation of the door handle assembly is seen by a comparison of FIG. 2 (door handle assembly closed) and FIG. 3 (door handle assembly open). Specifically, as the door handle assembly is moved from the closed configuration of FIG. 2 to the open configuration of FIG. 3, the leg portion 30*b* of the handle slidably engages the leg portion 32*b* of the bellcrank actuator to pivot the bellcrank about its pivot axis and exert a pulling force on rod 54 to release latch assembly 43 and allow opening movement of the door. Side impact lever 34 does not interfere with this movement since it is maintained in a position forming a linear extension of bellcrank arm 32*b* by coil spring 36, and, as best seen in FIG. 4, passes above the stop portion 28*c* of the escutcheon plate. The side impact lever, therefore, does not interfere in any way with the normal movement of the door handle assembly from the closed position seen in FIG. 2 to the open position seen in FIG. 3.

Figure 5:
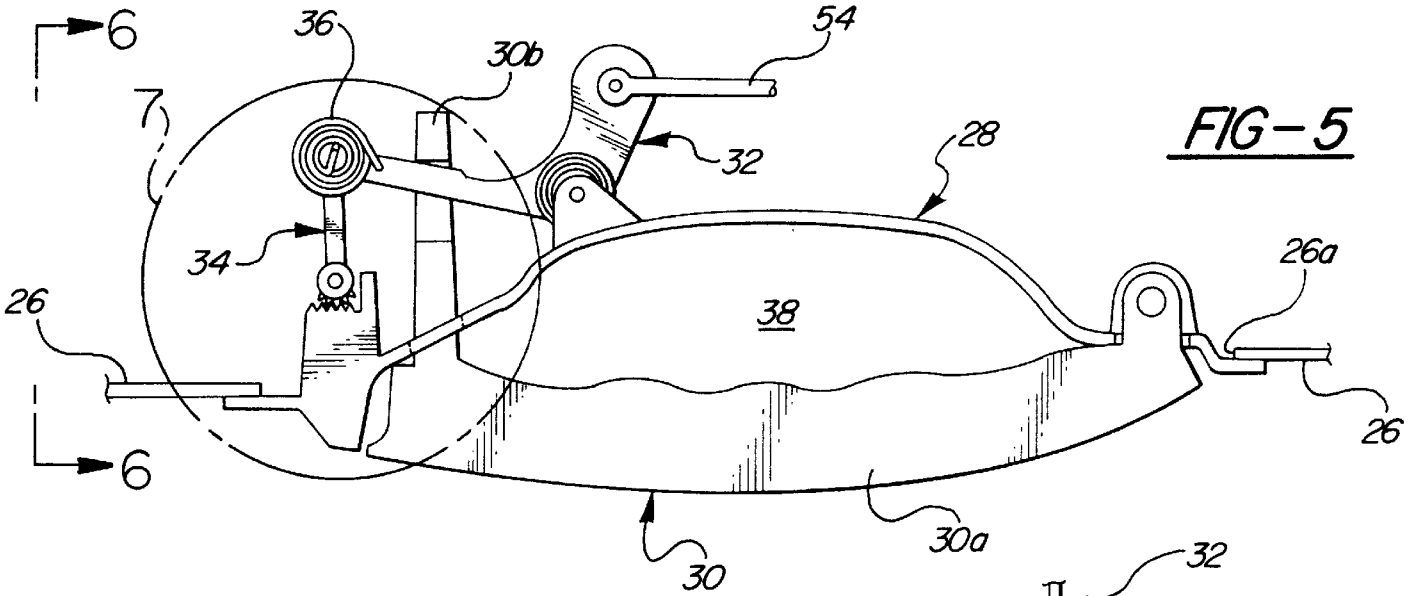
FIG. 5 is a top view of the door handle assembly in a side impact condition.
Figure 6:
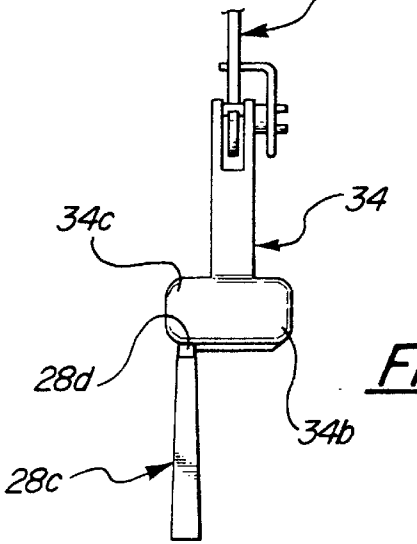
FIG. 6 is a fragmentary end view looking in the direction of the arrow 6 in FIG. 5.
Figure 7:
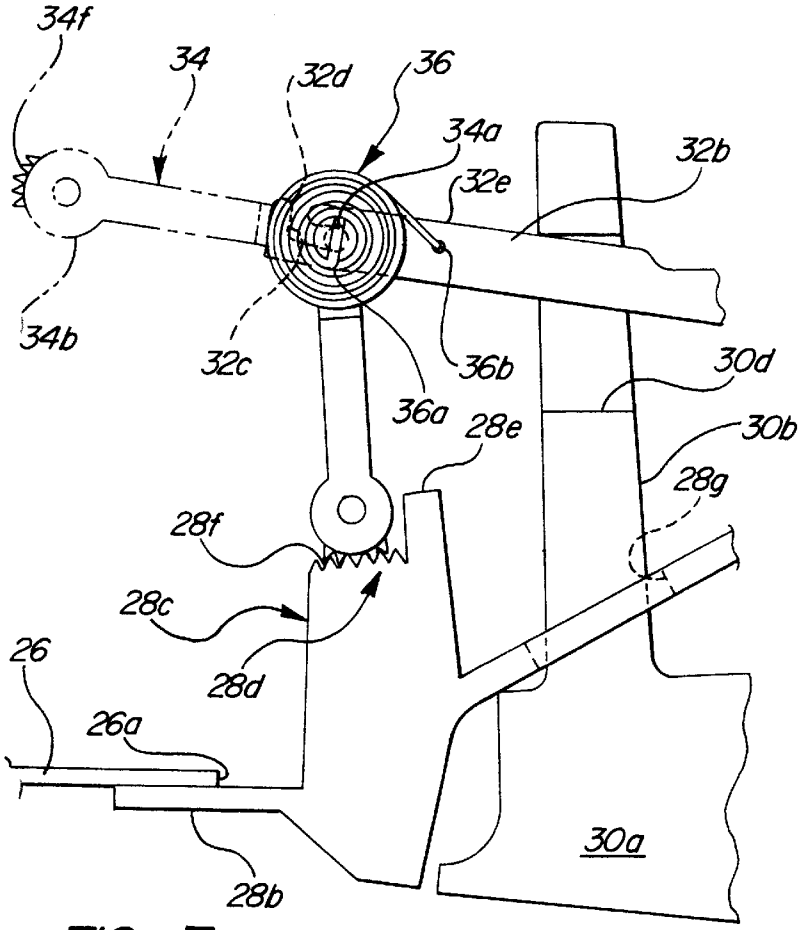
FIG. 7 is an enlarged view taken within the circle 7 in FIG. 5.

However, side impact lever 34 functions to preclude movement of the door handle from the closed position of FIG. 2 to the open position of FIG. 3 in the event of a side impact, such as represented schematically by arrow 58 in FIGS. 1 and 8. Specifically, in the event of a side impact 58 against the door 26, side impact lever 34, acting inertially, pivots immediately about the axis of pin 34*c* to the blocking position seen in in FIG. 5 and 7. In this position, offset end portion 34*g* of weight 34*b* is in confronting relation to escutcheon stop surface 28*e* and escutcheon stop surface 28*d*. Escutcheon stop surface 28*e* coacts with offset end portion 34*g* of weight 34*b* to limit and define the pivotal movement of the side impact lever and stop the lever in a position in which it extends generally in a direction normal to the plane of the door, and escutcheon stop surface 28*d* coacts with offset end portion 34*g* of weight 34*b* to preclude any significant amount of pivotal movement of the handle 30 about the axis of pin 41. Any such incipient pivotal movement of the handle is terminated immediately by engagement of the offset end portion 34*g* of the weight with stop surface 28*d*. Weight teeth 34*f* and stop surface teeth 28*f* coact upon arrival of the weight at a position proximate the surface 28*e* to latch the side impact lever in a position proximate stop surface 28*d* and extending generally perpendicular to the plane of the door.

It will be understood that the spring constants and other parameters of the system are chosen such that spring 40 offers substantially more resistance to pivotal movement of the handle about the axis of pin 41 than spring 36 offers to the pivotal movement of the side impact lever about the axis of pin 34*c* so that the inertial forces generated upon the side impact operate to swing the side impact lever to its blocking position before the handle has a chance to pivot toward its unlatched position. It will be seen that weight 34*b*, in addition to providing offset end 34*g* for coaction with escutcheon stop surfaces 28*d* and 28*e*, also serves to move the center of gravity of side impact lever 34 further outwardly with respect to the pivot axis of the side impact lever so as to enhance the inertial pivotal movement of the side impact lever in response to a side impact.

The invention door handle assembly will be seen to provide an effective means of precluding inadvertent unlatching of a vehicle door latch mechanism in the event of side impact while yet not providing any significant resistance to a normal opening movement of the door handle. Specifically, since handle spring 40 need only provide enough resistance to pivotal movement of the handle to allow the side impact lever to move first to its blocking position rather than itself providing the resistance to opening movement of the door handle in a side impact situation, the resistance to opening movement provided by spring 40 may be maintained within normal, comfortable limits. Further, whereas the prior art use of the spring 40 to preclude movement of the door handle in the event of side impact limits the ability of the door handle to resist side impact to the G forces that may be resisted by the spring 40, in the invention door handle assembly there is no limit to the G forces that may be resisted since the invention arrangement results in the creation of a solid blocking link that precludes inadvertent opening of the door irrespective of the magnitude of the G forces generated by the side impact.

Whereas a preferred embodiment of the invention has been illustrated and described in detail. It will be apparent that various changes have been made in the disclosed embodiment without departing from the scope and spirit of the invention.

What is claimed is:

1. A motor vehicle door handle assembly for actuating a door latch of the vehicle to allow opening and closing of the vehicle door, the door handle assembly including a door handle pivotally movable between a closed position in which the latch maintains the door in a closed position and an open position in which the latch is unlatched to allow opening of the door, characterized in that:

the door handle assembly includes an actuator lever operated by the handle and mounted for pivotal movement about an axis remote from the handle pivot axis in response to pivotal movement of the handle; and the door handle assembly further includes a side impact detector member comprising a lever pivotally mounted on the actuator lever and operative in response to a side impact against the door with the handle in its closed position to move inertially from a neutral position, allowing movement of the handle to its open position, to a side impact position, blocking movement of the handle to its open position.

2. A motor vehicle door handle assembly according to claim 1 wherein:

the assembly provides less resistance to movement of the side impact lever to its side impact position than to movement of the door handle to its open position, in the case of a side impact.

3. A motor vehicle door handle assembly according to claim 2 wherein:

the actuator lever includes a free end; and the side impact lever is pivotally mounted on the free end of the actuator lever.

4. A motor vehicle door handle assembly according to claim 3 wherein the door handle assembly further includes a coil spring concentrically arranged with respect to the pivot axis of the side impact lever and providing resistance to pivotal movement of the side impact lever about its pivot axis.

5. A motor vehicle door handle assembly according to claim 3 wherein the side impact lever in its neutral position forms a linear extension of the actuator lever.

6. A motor vehicle door handle assembly according to claim 5 wherein:

the actuator lever comprises a bellcrank lever;

the bellcrank lever is pivotally mounted between its ends to the door;

the side impact lever is pivotally mounted to the free end of one leg of the bellcrank lever;

the door handle assembly further includes a link pivotally mounted to a free end of another leg of the bellcrank lever and operating the door latch of the door handle assembly; and the door handle is pivotally mounted at one end thereof on the door and engages at another end thereof with the bellcrank lever at a location between the bellcrank lever pivot axis and the free end of the one leg of the bellcrank lever.

7. A motor vehicle door handle assembly according to claim 6 wherein the one leg of the bellcrank lever passes through an oversize opening in the handle.

8. A motor vehicle door handle assembly according to claim 7 wherein:

the door handle includes a main body portion sized for grasping by a motor vehicle operator to actuate the door handle assembly and a leg portion proximate the other end of the door handle; and the oversized opening is defined in the leg portion of the door handle.

9. A motor vehicle door handle assembly for actuating a door latch of a vehicle to allow opening and closing of the vehicle door, the door handle assembly comprising:

a door handle moveable between a closed position in which the latch maintains the door in a closed position and an open position in which the latch is unlatched to allow opening of the door;

a blocker member mounted for inertial movement between a neutral position, in which the door handle is free to move to its open position, and a blocking position, in which the door handle is precluded from moving to its open position;

means operative in response to a side impact against the door to move the blocking member inertially from its neutral position to its blocking position, whereby to block movement of the door handle to its open position and preclude inadvertent opening of the door;

the blocker member comprising a blocker lever mounted for pivotal movement from its neutral position to its blocking position in response to side impact;

the door handle assembly further including an actuator lever separate from but operated by the handle and mounted for pivotal movement in response to movement of the handle;

the blocker lever being pivotally mounted at one end thereof on the actuator lever and carrying a weight at the other, free end thereof, to accentuate the pivotal movement of the blocking lever in response to side impact.

10. A motor vehicle door handle assembly according to claim 9 wherein the blocking lever in the neutral position extends generally parallel to the plane of the door and in the blocking position extends generally normal to the plane of the door.

* * * * *